US009709013B2

(12) United States Patent
Yudanov

(10) Patent No.: US 9,709,013 B2
(45) Date of Patent: Jul. 18, 2017

(54) FUEL SYSTEM AND METHOD FOR REDUCING FUEL LEAKAGE FROM A FUEL SYSTEM

(75) Inventor: Sergi Yudanov, Västra Frölunda (SE)

(73) Assignee: Volvo Lastvagnar AB, Göteborg (SE)

( * ) Notice: Subject to any disclaimer, the term of this patent is extended or adjusted under 35 U.S.C. 154(b) by 672 days.

(21) Appl. No.: 14/124,283

(22) PCT Filed: Jan. 18, 2012

(86) PCT No.: PCT/EP2012/000213
§ 371 (c)(1),
(2), (4) Date: Dec. 6, 2013

(87) PCT Pub. No.: WO2012/171593
PCT Pub. Date: Dec. 20, 2012

(65) Prior Publication Data

US 2014/0109874 A1 Apr. 24, 2014

Related U.S. Application Data

(60) Provisional application No. 61/496,595, filed on Jun. 14, 2011.

(51) Int. Cl.
*F02M 69/02* (2006.01)
*F02M 59/44* (2006.01)
*F02M 25/06* (2016.01)

(52) U.S. Cl.
CPC ..... *F02M 69/02* (2013.01); *F02M 59/44* (2013.01); *F02M 25/06* (2013.01)

(58) Field of Classification Search
CPC ..... F02M 59/44; F02M 59/442; F02M 59/46; F02M 59/462; F02M 59/464;
(Continued)

(56) References Cited

U.S. PATENT DOCUMENTS 4,478,423 A * 10/1984 Hjelsand ..... F16J 15/183 277/516
5,979,415 A * 11/1999 Sparks ..... F02M 59/366 123/446
(Continued)

FOREIGN PATENT DOCUMENTS

CN 201277763 * 7/2009
DE EP 1275843 A2 * 1/2003 ..... F01M 9/10
(Continued)

OTHER PUBLICATIONS

European Official Action (Apr. 14, 2015) for corresponding European Application 12 702 413.1.
(Continued)

*Primary Examiner* — Carlos A Rivera
*Assistant Examiner* — Carl Staubach
(74) *Attorney, Agent, or Firm* — WRB-IP LLP

(57) ABSTRACT

A fuel system is provided for supplying pressurized fuel, in particular dimethyl ether (DME) or a blend thereof, to an internal combustion engine. The fuel system includes a fuel pump, which has a pumping mechanism arranged partly in a housing containing lube oil, a drain line connected to the housing and suitable for draining at least fuel vapor from an interior of the housing, a lube oil supply line connected to the housing, a lube oil supply valve installed in the lube oil supply line, a seal installed between the pumping mechanism and the housing for preventing at least lube oil leakage to the outside of the housing, and a drain valve installed in the drain line, wherein both the drain valve and lube oil supply valve are controlled to be closed during an engine non-running state for preventing fuel vapor leakage from the housing.

28 Claims, 5 Drawing Sheets

(58) Field of Classification Search
CPC ..... F02M 59/466; F02D 45/00; F02D 33/003; F02D 2041/225; F02D 2041/226; F02D 19/0681; F02D 19/0684; F16N 13/02; F01M 2011/021; F01M 11/0458; F01M 2011/0466; F01M 2011/0475
USPC ..... 123/446, 445, 447, 456, 457, 458, 459, 123/461, 463, 479, 505, 518, 510, 511, 123/196 R; 184/26
See application file for complete search history.

(56) References Cited

U.S. PATENT DOCUMENTS

| | | | | | |
|---|---|---|---|---|---|
| 5,983,863 | A * | 11/1999 | Cavanagh | F02D 41/20 | 123/447 |
| 6,123,174 | A * | 9/2000 | Elkin | F01M 11/0458 | 123/196 S |
| 6,189,517 | B1 * | 2/2001 | McCandless | F02M 63/0007 | 123/525 |
| 6,742,479 | B2 * | 6/2004 | Yanagisawa | F02M 63/0225 | 123/1 A |
| 6,805,105 | B2 * | 10/2004 | Kato | F02M 21/08 | 123/514 |
| 6,955,156 | B2 * | 10/2005 | Noda | F02M 53/00 | 123/364 |
| 7,287,517 | B2 * | 10/2007 | Nozaki | F02D 33/006 | 123/198 D |
| 8,061,328 | B2 * | 11/2011 | Shafer | F02M 39/005 | 123/196 R |
| 9,091,255 | B2 * | 7/2015 | Yoshimura | F02M 37/06 | |
| 2004/0091377 | A1 * | 5/2004 | Uryu | F02M 59/102 | 417/470 |
| 2005/0145223 | A1 | 7/2005 | Ushiyama et al. | | |
| 2006/0201484 | A1 * | 9/2006 | Shafer | F02M 39/005 | 123/456 |
| 2008/0202471 | A1 * | 8/2008 | Yudanov | F02M 55/002 | 123/446 |
| 2009/0008883 | A1 * | 1/2009 | Nakayama | F02M 59/102 | 277/596 |
| 2012/0145131 | A1 * | 6/2012 | Yoshimura | F02M 37/06 | 123/495 |
| 2014/0109874 | A1 * | 4/2014 | Yudanov | F02M 59/44 | 123/446 |

FOREIGN PATENT DOCUMENTS

| | | | |
|---|---|---|---|
| EP | 1 275 843 | A2 | 1/2003 |
| JP | S60-045869 | | 3/1895 |
| JP | H03 123921 | U | 12/1991 |
| JP | H03123921 | U | 12/1991 |
| JP | 10 281029 | A | 10/1998 |
| JP | 10281029 | A * | 10/1998 |
| JP | 10281029 | A2 | 10/1998 |
| JP | 2003042038 | A | 2/2003 |
| JP | 2003206825 | * | 7/2003 |
| JP | 2009 133262 | A | 6/2009 |

OTHER PUBLICATIONS

International Search Report (Nov. 14, 2012) for corresponding International Application PCT/EP2012/000213.
Japanese Official Action (Sep. 24, 2015) (translation) for corresponding Japanese Application JP 2014-515079.

* cited by examiner

FUEL SYSTEM AND METHOD FOR REDUCING FUEL LEAKAGE FROM A FUEL SYSTEM

BACKGROUND AND SUMMARY

This invention relates, according to an aspect thereof, to a fuel system for supplying pressurised fuel, in particular dimethyl ether (DME) or a blend thereof, to an internal combustion engine. The fuel system comprises a fuel pump, which has a pumping mechanism arranged partly in a housing containing lube oil, and a drain line connected to said housing and suitable for draining at least fuel vapour from an interior of said housing. An aspect of the invention also relates to a method for reducing fuel leakage from a corresponding fuel system.

The fuel system is particularly suitable for supplying low viscosity fuel, such as DME, to a diesel engine of a heavy truck.

In particular low viscosity fuel, such as DME, may leak past the high pressure seal of the pumping element into the camshaft chamber of the fuel pump, from where it may uncontrollably leak further out from the fuel system. One prior art solution to this problem is known from JP10281029A, where a leak gas pipe is provided between the camshaft chamber of the fuel pump and the air intake pipe of the combustion engine, so that during engine operation the gaseous fuel leakage may be removed from the camshaft chamber and safely burned off by the engine. Fuel vapour leakage to the ambient may however occur anyway to a limited extent in certain operating conditions.

There is thus a need for an improved fuel system removing the above mentioned disadvantage.

An aspect of the invention concerns fuel system for supplying pressurised fuel, in particular dimethyl ether (DME) or a blend thereof to an internal combustion engine, said fuel system comprising a fuel pump, which has a pumping mechanism arranged partly in a housing containing lube oil, and a drain line connected to said housing and suitable for draining at least fuel vapour from an interior of said housing.

An aspect of the invention is characterized in that said fuel system further comprises a lube oil supply line connected to said housing, a lube oil supply valve installed in said lube oil supply line, a seal installed between said pumping mechanism and said housing for preventing at least lube oil leakage to the outside of said housing, and a drain valve installed in said drain line, wherein both said drain valve and lube oil supply valve are configured to be closed during an engine non-running state for preventing fuel vapour leakage from said housing.

As described in connection with the prior art, fuel vapour leakage may occur to a limited extent in certain operating conditions despite the leak gas pipe, in particular in an engine non-running state when no negative pressure is generated by the power cylinders of the combustion engine. This problem is solved by an aspect of the invention by installing a drain valve in the drain line, and by closing the drain line upon entering an engine non-running state. Moreover, as a consequence of closing the drain line, relatively high pressure fuel vapour remains in said chamber of the fuel pump, and the inventive lube oil supply valve serves to prevent the confined pressurised fuel vapour from forcing the lube oil backwards through the lube oil supply line, in which event fuel vapour could propagate inside the engine via the lube oil system, or out from the engine via the crankcase ventilation, etc.

An aspect of the invention further concerns a method for reducing fuel leakage from a fuel system that is arranged to supply pressurised fuel, in particular dimethyl ether (DME) or a blend thereof, to an internal combustion engine, said fuel system comprising a fuel pump, which has a pumping mechanism arranged partly in a housing containing lube oil, and a drain line connected to said housing and suitable for draining at least fuel vapour from an interior of said housing.

The inventive method comprises the steps of connecting a lube oil supply line to said housing, installing a lube oil supply valve in said lube oil supply line, installing a seal between said pumping mechanism and said housing for preventing at least lube oil leakage to the outside of said housing, installing a drain valve in said drain line, and configuring both said drain valve and lube oil supply valve to be closed during an engine non-running state for preventing fuel vapour leakage from said housing.

According to an aspect of the invention, a lube oil fill level within said housing may at least during said engine non-running state be set such that said seal is completely immersed in lube oil during said engine non-running state for further enhancing fuel vapour sealing of said housing. The pumping mechanism of an aspect of the invention comprises at least a reciprocating pumping element and a drive mechanism for driving the pumping element by means of an external power device, such as the combustion engine. The seal installed between said pumping mechanism and said housing is arranged to prevent lube oil leakage to the outside of said housing. In the engine non-running state, confined pressurised fuel vapour is normally prevented from leaking past the seal by providing a seal, which is made of a material compatible with the fuel used, such that said seal exhibits low permeability to said fuel. However, sealing material compatible with in particular low viscosity fuels such as DME are expensive and may have lower durability than conventional seals, which are normally used for this sealing application. The solution of providing a completely immersed seal at least in the engine non-running state allows the use of conventional, and thus more economical sealing materials for the seal. Furthermore, the sealing performance of the fuel pump chamber is improved because the seal can be arranged for use exclusively as liquid oil seal, having inherently lower sensitivity to wear and deterioration as compared to a gaseous fuel seal.

According to an aspect of the invention, the lube oil supply valve may be adapted to be actuated hydraulically by the engine lube oil pressure, such that said lube oil supply valve is opened in an engine running state when the oil pressure is higher, and closed in said engine non-running state when the oil pressure is low. By configuring the lube oil supply valve to be actuated hydraulically by the engine lube oil pressure, an automatic opening control of the lube oil supply valve is realised that does not require any electronic control, thereby leading to reduced cost of the fuel system.

According to an aspect of the invention, the drain valve may be a spring loaded hydraulically operated control valve, wherein a pilot line of said control valve is connected to said lube oil supply line, such that a high oil pressure within said lube oil supply line caused by a running engine is arranged to open said drain valve, and a low oil pressure within said lube oil supply line caused by a non-running engine in combination with said spring loading is arranged to close said drain valve. By configuring the drain valve to be actuated hydraulically by the engine lube oil pressure, an automatic opening control of the lube oil supply valve is realised that does not require any electronic control, thereby leading to reduced cost of the fuel system.

According to an aspect of the invention, said seal may be made of a conventional oil seal robber material, such as nitrile rubber, hydrogenated nitrile rubber, silicone rubber, fluorinated rubber, or acrylic rubber, and said seal may be free from any DME resistant coating. Seals made of conventional, essentially non-DME resistant sealing materials are abundantly available, have low cost, and provide high and reliable sealing performance over a broad temperature range.

According to an aspect of the invention, at least a section or part of said drain line may function not only as fuel vapour drain line, but also as lube oil return line, and a lube oil separator may be provided along said drain line for separating lube oil from fuel vapour, wherein said lube oil separator is arranged downstream of said drain valve. By utilising the drain line both for draining fuel vapour and as lube oil return line, a single pipe connection to the housing is required for both said fluids, and a single control valve may be utilised for sealing the pumping mechanism chamber in the engine non-running state.

According to an aspect of the invention, said fuel system may further comprise a lube oil return valve capable of opening and closing a lube oil return line connected to said housing, wherein said lube oil return valve is adapted to be closed in said engine non-running state. Thus, this fuel system design does not utilise the drain line as lube oil return line, but provides a separate lube oil return line specifically for this purpose, i.e. provides a separate circulation path for the lube oil. Moreover, since the drain valve can no longer be used for closing the lube oil return line, an additional valve is provided in the return line for this purpose, namely the lube oil return valve. This design may thus possibly omit a lube oil separator installed in the drain line. Also, the location and dimension of the lube oil return line may be more specifically adapted to its purpose. Still more, the closing and opening control of the drain valve and lube oil return valve may be different from each other and optimised for their specific purposes.

According to an aspect of the invention, said lube oil return valve may be a spring loaded hydraulically operated control valve, wherein a pilot line of said lube oil return valve is connected to said lube oil supply line, such that a high oil pressure within said lube oil supply line caused by a running engine is arranged to open said lube oil return valve, and a low oil pressure within said lube oil supply line caused by a non-running engine in combination with said spring loading is arranged to close said lube oil return valve. By configuring the lube oil return valve to be actuated hydraulically by the engine lube oil pressure, an automatic opening and closing control of the lube oil return valve is realised that does not require any electronic control, thereby leading to reduced cost of the fuel system.

According to an aspect of the invention, said lube oil fill level may be controlled by the connection position of said lube oil return line to said housing, or by the connection position of said drain line to said housing. Depending on in which line the oil returns from the fuel pump to the low pressure lube oil reservoir of the engine, i.e. the drain line or the lube oil return line, the connection position of said line to the pumping mechanism housing may control the lube oil fill level of said chamber in a running engine, given that sufficient lube oil is supplied via the lube oil supply line. The lube oil fill level will then correspond substantially to the position of the outlet port of the drain/return line. More specifically, the lube oil fill level will correspond to the height from a lowest point of the chamber to the outlet port, measured in a vertical direction.

According to an aspect of the invention, said lube oil return line may be connected to a lower section of said housing, and said lube oil fill level is controlled by a, preferably electronic, lube oil level controller, which controls flow through said lube oil return valve. As an alternative to the design described above, where the position of the outlet port essentially determines the lube oil fill level, said fill level may instead be controlled by an electronic or other suitable lube oil level controller that controls opening and closing of the lube oil return valve. Here, the outlet port of the lube oil return valve is advantageously arranged sufficiently low in the pumping mechanism chamber, preferably at or near the bottom of the chamber. Otherwise, no efficient lube oil fill level, control may be realised.

According to an aspect of the invention, a safety means may be provided that can close said drain line. It may be advantageous to be able to close the drain line without being dependent on the drain valve, which may malfunction for same reason, or on correct control of the drain valve itself.

According to an aspect of the invention, said safety means also can close said lube oil supply line. It may be advantageous to be able to close the lube oil supply line without being dependent on the lube oil supply valve, which may malfunction for same reason, or on correct control of the lube oil supply valve itself.

According to an aspect of the invention, the fuel pump may also comprise a safety relief valve for preventing overpressure in said housing. The outlet of the safety relief valve may be connected either to the ambient or to the low-pressure part of the fuel system.

According to an aspect of the invention, said fuel pump may comprise at least one pumping chamber, and said pumping mechanism may comprise at least one pumping element for expanding and contracting said pumping chamber and a driving member for driving said at least one pumping element.

According to an aspect of the invention, said at least one pumping element may comprise a plunger, and said driving member may comprise a driveshaft with at least one cam for engagement with said at least one plunger.

According to an aspect of the invention, a single conventional high-pressure plunger seal may be provided between said at least one plunger and cylinder in which said plunger is reciprocally arranged, with said cylinder preferably being free from any drainage ports arranged to drain fuel leakage. By sealing the plunger merely with a single conventional high pressure plunger seal, without any complex fuel vapour drainage ports within the internal plunger cylinder, a less complex and more cost-effective fuel pump is provided.

BRIEF DESCRIPTION OF DRAWINGS

In the detailed description of an aspect of the invention given below reference is made to the following figure, in which.

DETAILED DESCRIPTION

Various aspects of the invention will hereinafter be described in conjunction with the appended drawings provided to illustrate and not to limit the invention, wherein like designations denote like elements.

Figure 1:
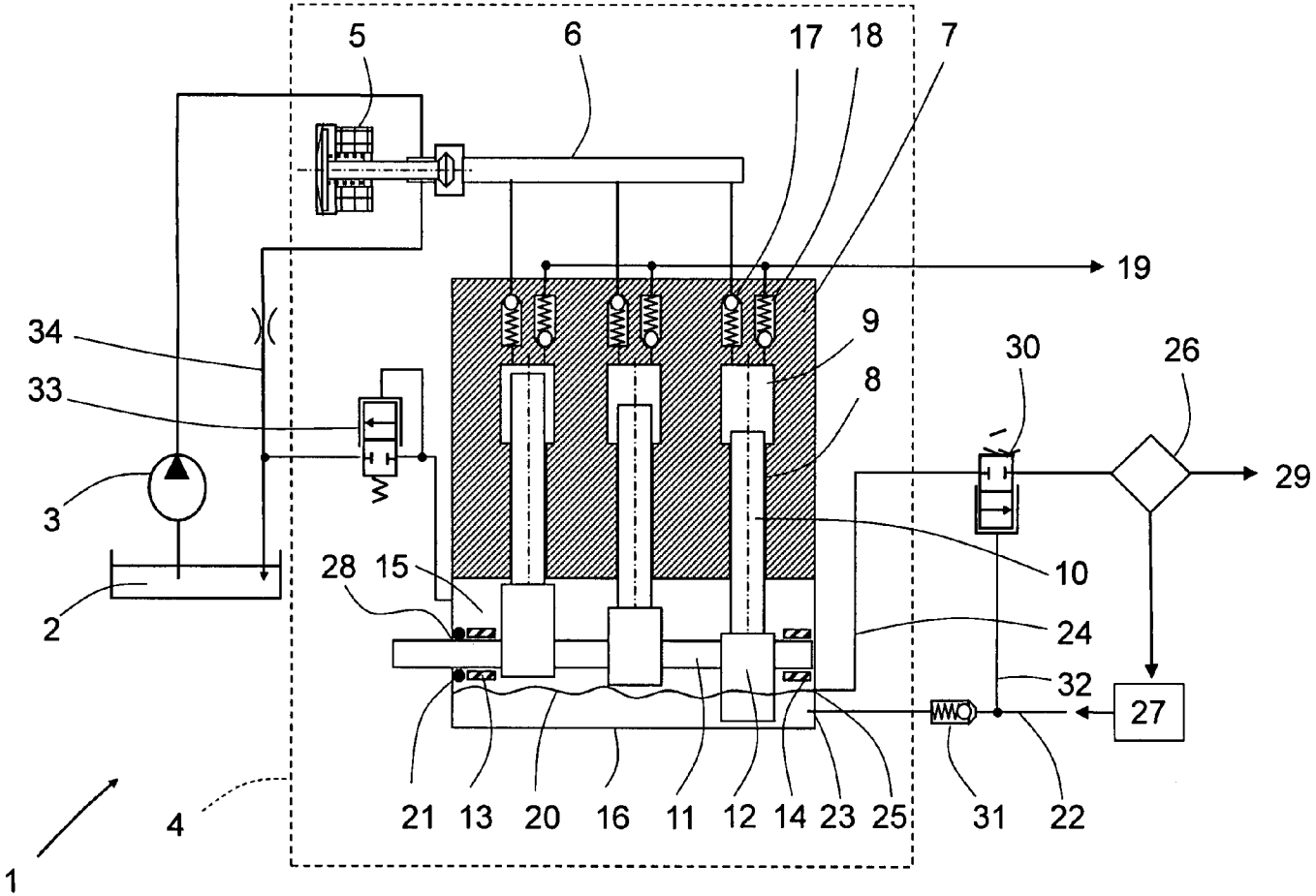
FIG. 1 shows a first embodiment of the fuel system according to an aspect of the invention.

FIG. 1 shows a first embodiment of the fuel system 1 according to an aspect of the invention. The fuel system 1 is particularly suitable for supplying pressurised low viscosity fuel, such as dimethyl ether (DME) or a blend thereof, to an internal combustion engine, but the fuel system 1 is equally suitable for conventional fuel, such as diesel. The fuel system 1 comprises a fuel tank 2 from which a low pressure fuel pump 3 draws fuel and supplies it to a high pressure fuel pump 4. The high pressure fuel pump 4, hereinafter simply referred to as fuel pump 4, is in many ways formed as a conventional fuel pump 4 that comprises an inlet metering valve 5 receiving fuel from the low pressure fuel pump 3. The inlet metering valve 5 controls the amount of fuel that is allowed to enter a suction channel 6, which functions as a fuel source for a pumping unit.

The pumping unit comprises a fuel pump block 7 with a plurality of pumping chambers 9 and cylinders 8, each cylinder 8 receiving a pumping element 10 in form of a plunger 10, which is driven by a driving member 1 in form of rotating driveshaft 11. The driving member 11 and pumping element 10 jointly form a pumping mechanism that is at least partly arranged within a housing 16 containing lube oil with a certain fill level 20. The driveshaft 11, which is rotatably mounted in bearings 13, 14 arranged in the housing 16, comprises a plurality of cams 12 for engagement with a corresponding plunger 10. The plunger 10 is arranged to expand and contract the pumping chamber 9 in a reciprocating motion that is caused by a corresponding cant 12 of the driveshaft 11.

During operation of the fuel pump, fuel from the suction channel 6 is sucked into the pumping chambers 9 via an inlet valve 17 upon expansion thereof, and supplied with high pressure to at least one fuel injector 19 of the engine via an outlet valve 18.

A single conventional high-pressure plunger seal is provided between each plunger 10 and corresponding cylinder 8 in which said plunger 10 is reciprocally arranged for reducing leakage of fuel into the chamber 15. Furthermore, the cylinders 8 are preferably free from any drainage ports for draining fuel leakage that gets past the high-pressure plunger seals. A seal 21 is also installed between the driveshaft 11 and the housing 16. The seal 21 is preferably a conventional oil seal, in particular a rotary shaft lip seal, preferably including a garter spring. The purpose of the seal 21 is to prevent leakage of lube oil and fuel vapour to the outside of the housing 16.

The fuel system according to an aspect of the invention is disclosed using a plunger fuel pump with three plungers 10, but the inventive fuel system is equally applicable to plunger fuel pumps with less or more plungers, or to other types of fuel pumps, such as for example swash-plate driven fuel pumps, etc.

The fuel pump 4 is lubricated by means of lube oil circulating through the chamber 15 upon operation of the fuel pump 4. The lube oil is supplied to the chamber 16 from a low pressure lube oil reservoir 27, such as an oil sump or oil pan by a lube oil supply line 22 that is connected to the housing 16 at an inlet port 23. The lube oil is subsequently returned to low pressure lube oil reservoir 27 via a drain line 24 that is connected to the housing 16 at an outlet port 25, and a lube oil separator 26 that is provided along the drain line 24 for separating lube oil from fuel vapour which is also drained from the housing 16. The vertical position of the lube oil outlet port 25 determines the lube oil fill level 20 within the housing 16.

A high pressure fuel vapour relief valve 33 connecting the chamber 16 with a fuel return line 34 may also be provided to avoid any damages to components of the chamber 15 due to excessive pressure.

In an engine running-state, high pressure fuel vapour from the compression chambers 9 tends to leak past any high pressure seal of the cylinders 8 and into the chamber 15 of the driveshaft 11. It is highly undesirable to have any leakage of fuel or fuel vapour from the fuel system, and when fuel vapour enters the chamber 15, there is a risk that it propagates further within and finally out of the engine, such as for example via the inlet or outlet ports 23, 25 of the lube oil system, or the opening 28 of the chamber 16 where driving torque is supplied to the pumping mechanism. Pressurised fuel vapour is thus highly undesired within the chamber 15.

During the engine running-state, it is commonly known to drain the fuel vapour from the chamber 15 to a device that can handle the fuel vapour safely, such as for example an air intake port 29 of said engine. Thereby, fuel vapour drained from housing 16 may be aspired into the combustion chamber of the engine, safely eliminating any risk of uncontrolled leakage of fuel or fuel vapour.

However, during the engine non-running state, this drainage of fuel vapour does no longer function due to lack of negative pressure at the intake port of the engine. As a result, fuel vapour remaining within the chamber 15 upon entering the engine non-running state, and leaked thereto from the compression chambers 9, may spread uncontrolled within and outside the engine. An aspect of the invention solves this problem by using the drain line 24 also for draining fuel vapour in the engine running state, by providing a drain valve 30 installed in the drain line 24, and a lube oil supply valve 31 installed in the lube oil supply line 22, wherein both the drain valve 30 and lube oil supply valve 31 are configured to be closed during the engine non-running state for preventing the fuel vapour leaking from the housing 16.

The inventive fuel system thus effectively seals the chamber 15 in the engine non-running state, thereby preventing pressurised fuel vapour from spreading from the chamber 15 further into the engine. Without this sealing, fuel vapour would propagate out via the lube oil system and/or drain line to the combustion chambers, possibly leading to damages upon start of the engine.

The seal 21 of the driveshaft 11 may be made of a material with high resistance to the fuel vapour present in the housing. A lube oil film may also, or alternatively, be present on the seal 21 after operation of the fuel pump, thereby preventing fuel vapour leaking past and/or permeating through the seal 21.

Using the drain line 24 both for draining fuel vapour and returning lube oil and arranging the lube oil separator 26 downstream of the drain valve 30 allows Using the drain line 24 both for draining fuel vapour and returning lube oil and arranging the lube oil separator 26 downstream of the drain valve 30 allows the use of a single drain valve 30 for both said flows, thereby rendering a simplified and more cost effective design possible.

The lube oil supply valve 31 is preferably formed as spring loaded check valve, which is arranged to allow flow of lube oil in a single direction only. The lube oil supply valve 31 is further adapted to be actuated hydraulically by the engine lube oil pressure, such that the lube oil supply valve 31 is opened in an engine running state when the oil pressure is higher, and closed in said engine non-running state when the oil pressure is low. This automatic operation of the lube oil supply valve by means of engine lube oil pressure results in a simple and robust design without the need for electronic control. The inventive fuel system is however not limited to a spring loaded check valve, but more sophisticated valve solutions may be implemented, possibly including an electronically controllable valve.

The drain valve 30 is configured to be open during an engine running state for draining fuel vapour from the housing 16, and allowing lube oil to return to the lube oil reservoir 27. The drain valve 30 may for example be a hydraulic or solenoid operated control valve. The drain valve 30 is preferably a spring loaded hydraulically operated control valve, wherein a pilot line 32 of the drain valve 30 is connected to the lube oil supply line. Thereby, a high oil pressure within the lube oil supply line caused by a running engine is adapted to open the drain valve 30, and a low oil pressure within lube oil supply line caused by a non-running engine in combination with the spring loading is adapted to close the drain valve 30. The drain valve 30 is thus adapted to open and close automatically based on the oil supply pressure, thereby providing a simple and robust design without the need for electronic control. The inventive fuel system is however not limited to a spring loaded hydraulically operated control valve, but more or less sophisticated valve solutions may be implemented, possibly including an electronically controllable valve.

Figure 2:
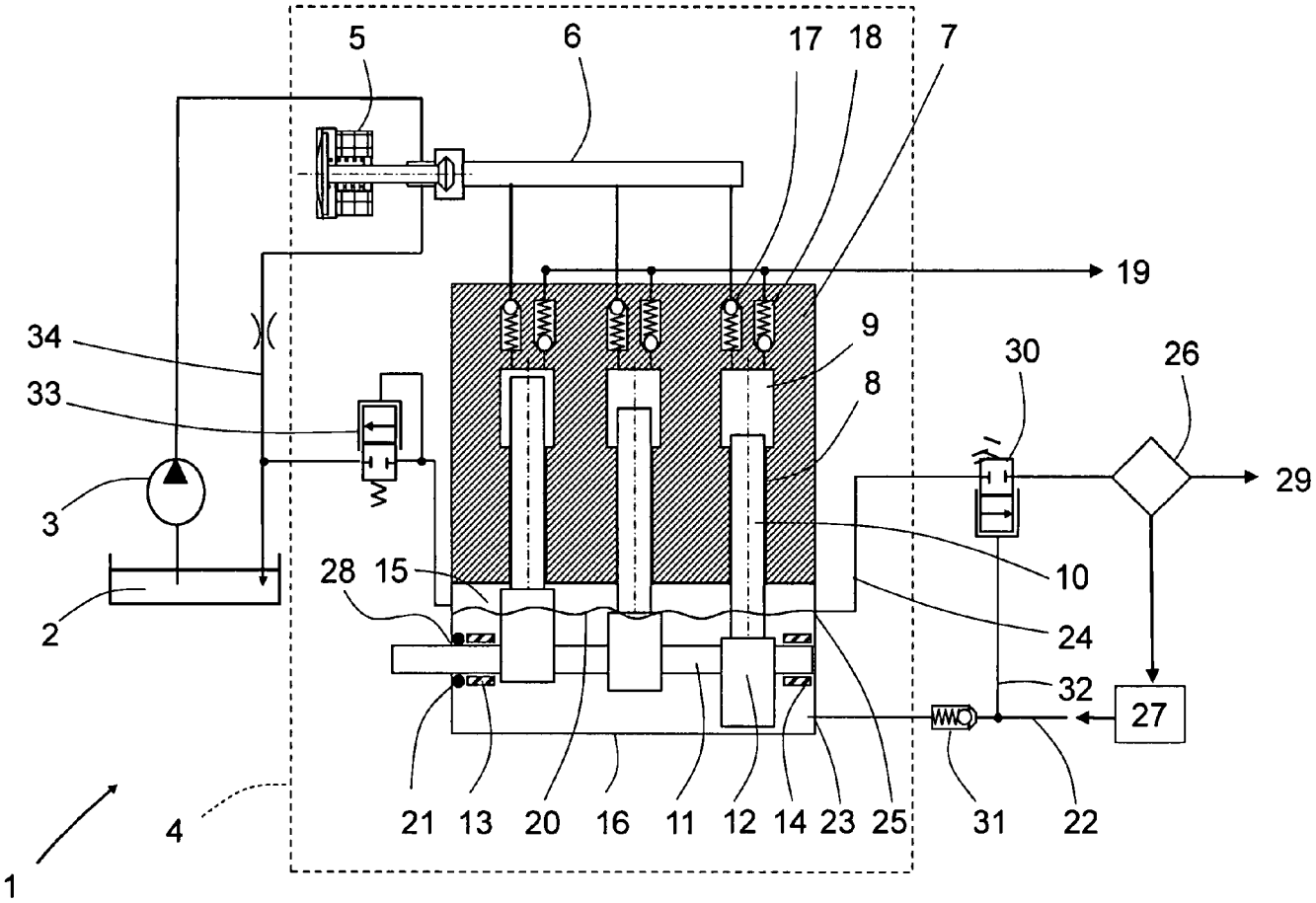
FIG. 2 shows a second embodiment of the fuel system according to an aspect of the invention.

FIG. 2 shows schematically a second embodiment of an aspect of the invention that is very similar to the first embodiment, differing only in the lube oil fill level 20. In this embodiment of an aspect of the invention, the lube oil fill level is increased to an extent to completely cover the seal 21 provided between the pumping mechanism and housing 16. The main advantage of an increased lube oil fill level 20 such that the seal 21 is completely immersed in tube oil during said engine non-running state is further enhanced fuel vapour sealing of the housing 16 because fuel vapour cannot easily permeate through a relatively thick layer of lube oil. Compared with the first embodiment, here the fuel compatibility of the seal material is thus less important, and the seal 21 may be made of a conventional, more economical oil seal rubber material, such as nitrile rubber, hydrogenated nitrile rubber, silicone rubber, fluorinated rubber, or acrylic rubber. Moreover, the seal 21 may also be free from any expensive DME resistant coating that otherwise may need to be applied to attain the required sealing performance. The solution of FIG. 2 thus provides an improved fuel vapour sealing performance, possibly using a conventional, more economical seal material for the seal 21.

The increased lube oil fill level 20 is configured to be applied at least in the engine non-running state, but may be applied also in the engine running state. It may be advantageous to have a reduced lube oil fill level during engine running state due to reduced energy losses caused by the splashing of the lube oil by the driveshaft 11, but an adaptive tube oil fill level system requires a more complex lubrication system of the fuel pump 4.

Figure 3:
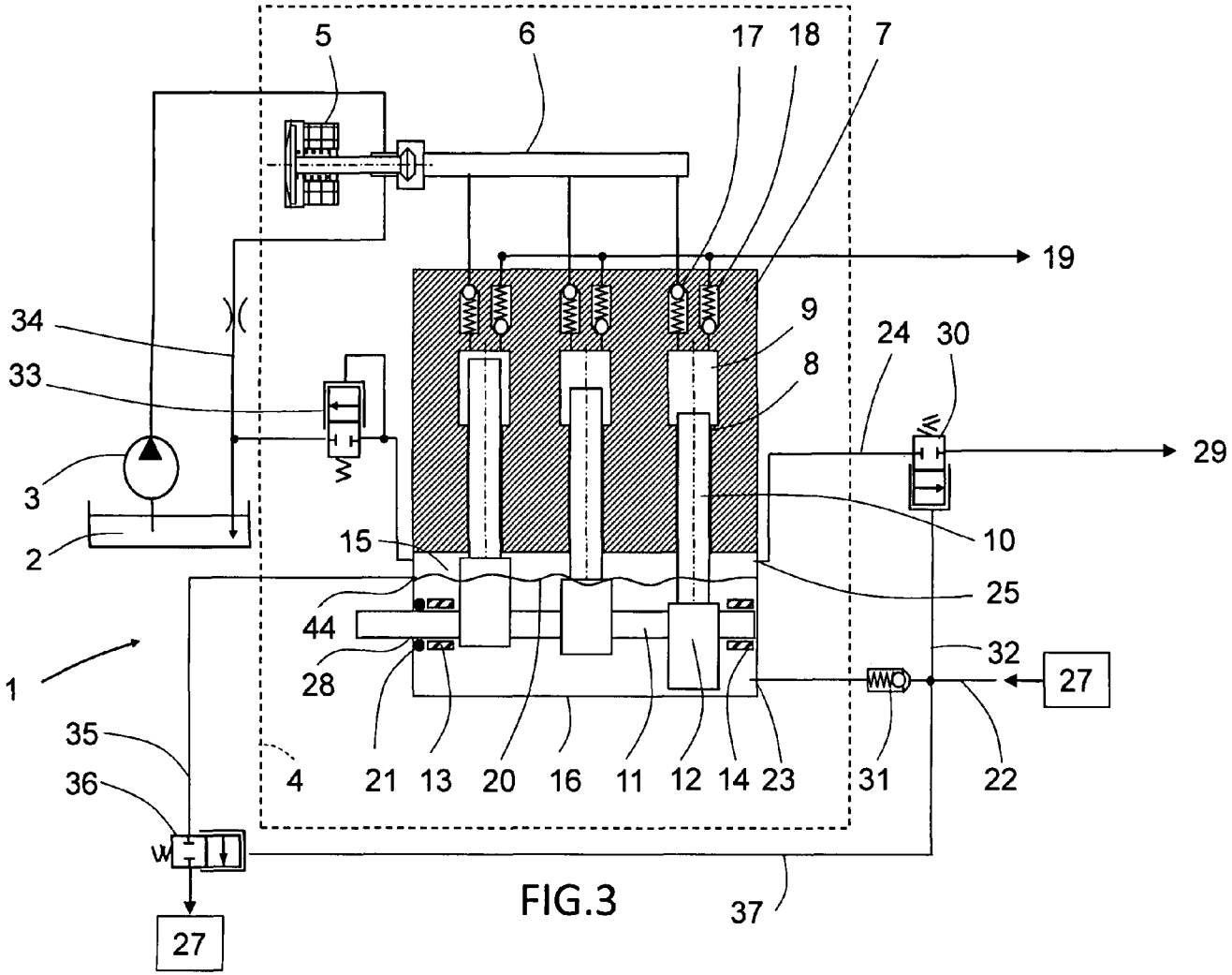
FIG. 3 shows a third embodiment of the fuel system according to an aspect of the invention.
Figure 4:
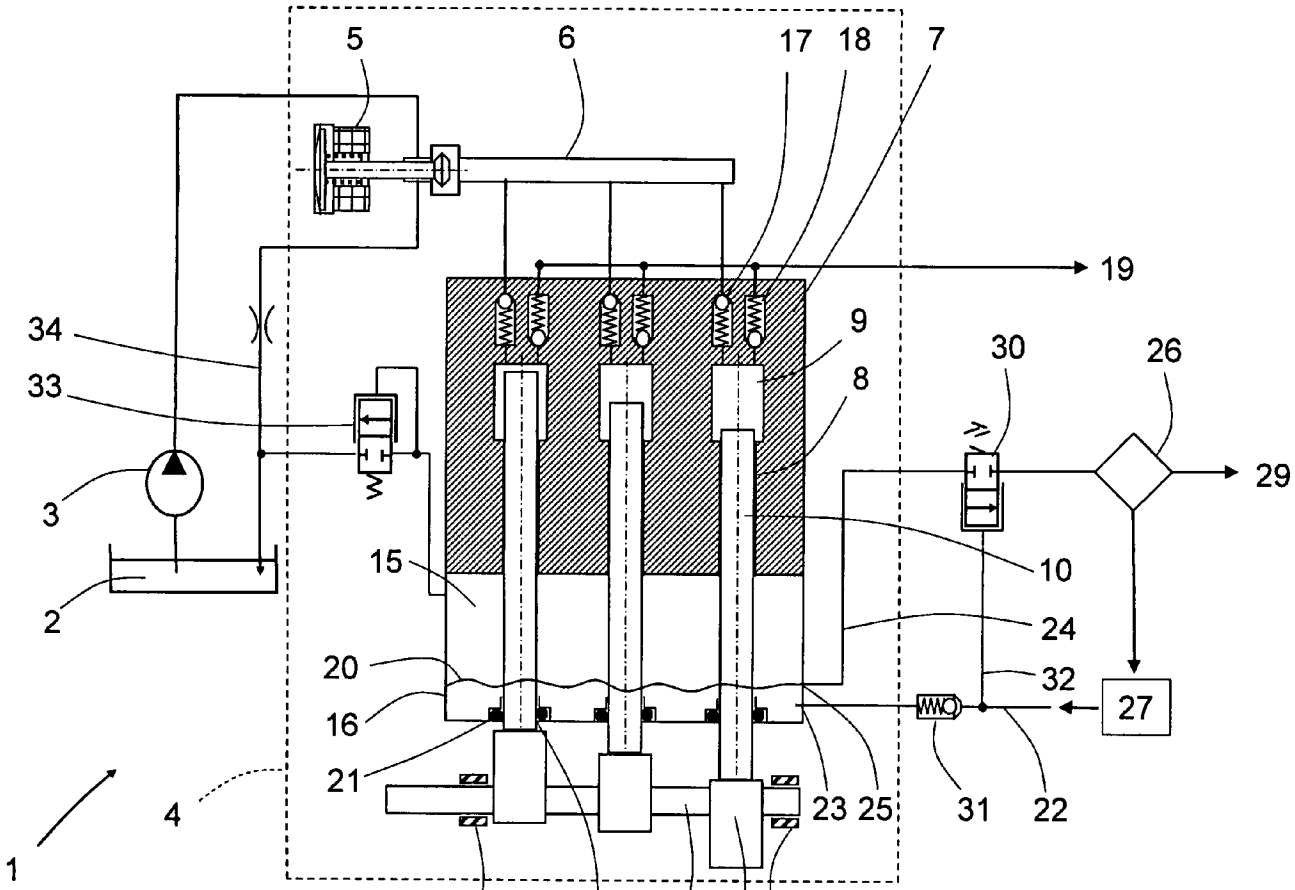
FIG. 4 shows a fourth embodiment of the fuel system according to an aspect of the invention.

FIG. 3 shows schematically a third embodiment of an aspect of the invention, displaying an alternative lube oil return arrangement. The difference with respect to the previous embodiment is only in that a separate lube oil return valve 36 is installed in a separate lube oil return line 35. The lube oil return valve 36 being capable of opening and closing the lube oil return line 35, which connects the housing 16 with the low pressure lube oil reservoir 27. The function of the fuel system have not changed, and the lube oil return valve 36 is configured to be open during an engine running state, and closed in the engine non-running state. The difference with respect to the previous embodiment is merely that the drain line 24 and drain valve 30 are adapted for handling of fuel vapour, whilst the separate lube oil return line 35 and return valve 36 are adapted for handling of lube oil. The lube oil separator 26 may thus no longer be required.

The advantage of the design of the third embodiment shown in FIG. 3 is mainly the possibility to better adapt the drain line/valve 24, 30 to the properties of the specific fuel vapour that will be flowing there through, and to better adapt the return line/valve 35, 36 to the properties of the specific lube oil that will be flowing there through. Moreover, as already mentioned, lube oil separator 26 can be omitted, thereby saving space and resulting in reduced service requirement of the fuel system.

The lube oil return valve 36 may be a hydraulic or solenoid operated control valve. The lube oil return valve 36 is preferably a spring loaded hydraulically operated control valve, wherein a pilot line 37 of the lube oil return valve 36 is connected to the lube oil supply line 22, such that a high oil pressure within the lube oil supply line 22 caused by a running engine is arranged to open the lube oil return valve 36, and a low oil pressure within said lube oil supply line 22 caused by a non-running engine in combination with said spring loading is arranged to close said lube oil return valve 36.

As before, the lube oil fill level 20 is controlled by the connection position of the lube oil return line 35 to the housing 16. The inventive fuel system is however not limited to a spring loaded hydraulically operated control valve, but more or less sophisticated valve solutions may be implemented, possibly including an electronically controllable valve.

which is sealed by a seal 21. The seal 21 may be a conventional oil seal, in particular a reciprocating shaft lip seal, preferably including a garter spring, and since the seal 21 is arranged to be completely immersed in lube oil during at least the engine non-running state, essentially no fuel vapour may permeate and/or leak past the seal 21 in the engine non-running state.

The driving member, here the driveshaft 11, of the pumping mechanism is rotatably arranged outside the housing 16 by means of bearings 13, 14, that are supported by the fuel pump in a non-showed design. The remaining fuel system according to the fourth embodiment corresponds essentially to the fuel system according to the first embodiment.

Figure 5:
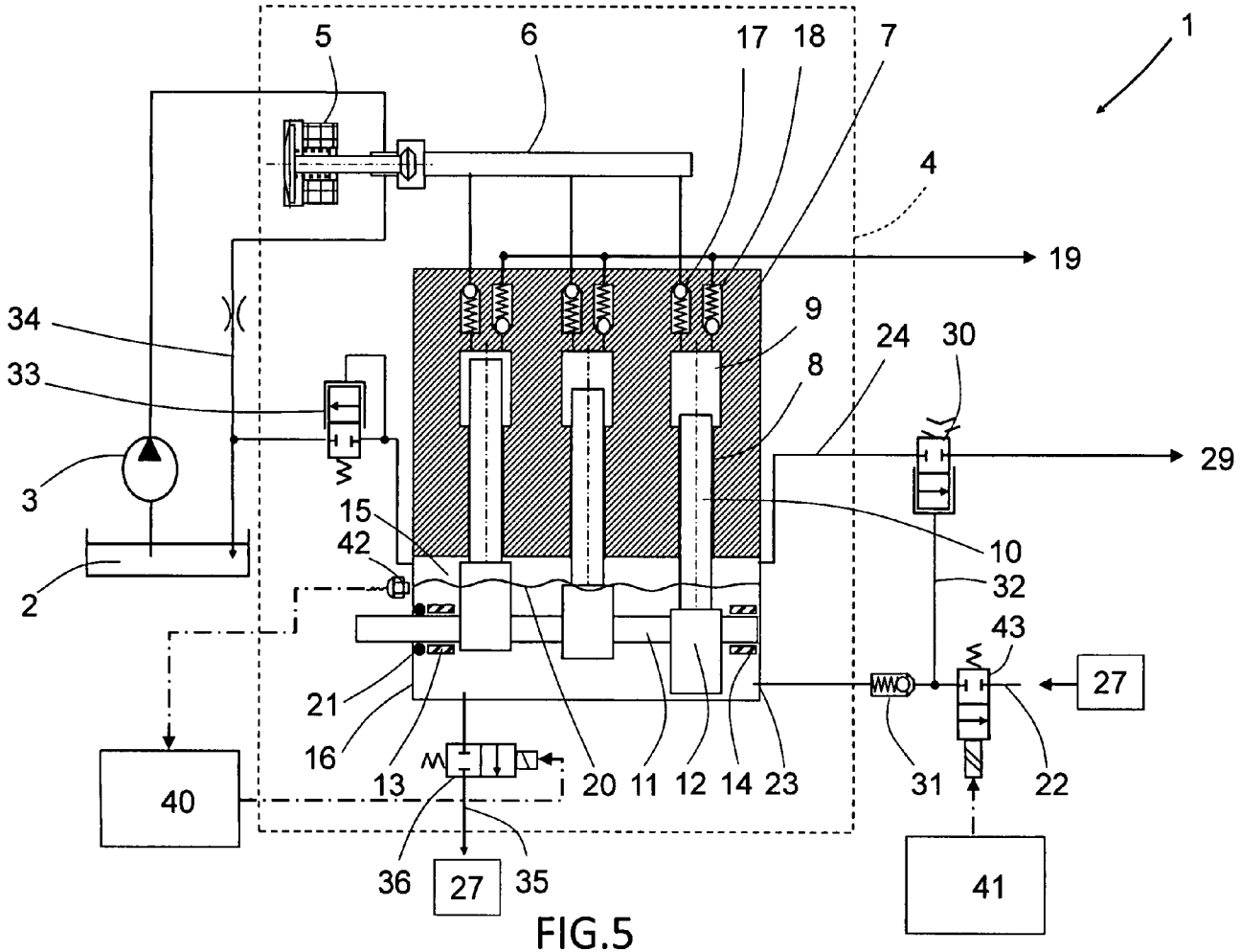
FIG. 5 shows a fifth embodiment of the fuel system according to an aspect of the invention.

FIG. 5 shows schematically a fifth embodiment of an aspect of the invention displaying yet another alternative lube oil return arrangement. Here, the lube oil return line 35 is connected to a lower section of said housing 16, adjacent the bottom of the housing 16, and the lube oil fill level 20 is controlled by an electronic lube oil level controller 40, which controls flow through the lube oil return valve 36 based on input from an oil detection sensor 42. This lube oil return arrangement more easily allows an adaptable lube oil fill level 20, and the opening and closing timing of the lube oil return valve is independent from the lube oil pressure within lube oil supply line 22.

A safety means 41, 43 is also provided in the form of an electronic control unit 41 and an electronically controlled safety valve 43, which is arranged to control the flow of lube oil from the lube oil reservoir 27 to the fuel system 1. The safety means 41, 43 is also arranged to be able to close the drain, line 24 to increase the certainty that the drain line indeed is closed in the engine non-running state, or in case the high-pressure fuel leakage in the pump 4 has increased dramatically, for instance due to a plunger seal failure, to a level that could alone sustain engine operation. The closing of the drain line is here realised by closing the lube oil supply line 22, thereby inactivating also the pilot line 32 of the drain valve 30, such that the spring of the drain valve 30 closes the valve.

Common for all shown embodiments in which the seal 21 is configured to be immersed in lube oil is that the seal 21 is configured to be completely immersed in the liquid lube oil during ordinary use of the engine and vehicle. This feature is obviously dependent on the position and inclination of the fuel pump 4, and the state of total immersement should of course be maintained even at a certain level of inclination of the vehicle, because a vehicle comprising the inventive fuel system may be parked on a slope having a certain inclination. It is important that the seal 21 remains totally immersed in liquid lube oil at typical maximum inclinations that can be encountered in use. Such inclinations may for example be –/–30° from the horizontal orientation of the vehicle.

The relevant lube oil fill level during an engine non-running state is determined when the lube oil has settled after being splashed about by the driveshaft, and not immediately after engine shut down when much of the lube oil is still splattered all over inside the housing 16.

Variations of the fuel system according to an aspect of the invention, as illustrated by the different embodiments, should not be interpreted as limited to exactly said embodiment, but said variations may be applied to other embodiments as well when not inconsistent with each other. For example, the separate lube oil return line 35 and return valve 36 may alternatively be implemented in the fuel system of the first, fourth or fifth embodiment. The arrangement of the driving member 11 outside the housing 16 may alternatively be implemented in the fuel system of the second, third or fifth embodiment. The lube oil level controller 40 and/or safety means 41, 43 may alternatively be implemented in the fuel system of any of the first to the fourth embodiment. An additional preliminary oil separator can be installed in the drain line 24 upstream of the oil separator 26 for improved separation efficiency of the entire system. Oil separator 26 may for instance be part of the conventional crank case ventilation system of the engine.

Reference signs mentioned in the claims should not be seen as limiting the extent of the matter protected by the claims, and their sole function is to make claims easier to understand.

As will be realised, an aspect of the invention is capable of modification in various obvious respects, all without departing from the scope of the appended claims. Accordingly, the drawings and the description thereto are to be regarded as illustrative in nature, and not restrictive.

The invention claimed is:

1. Fuel system for supplying pressurised fuel to an internal combustion engine, the fuel system comprising:

a fuel pump, which has a pumping mechanism arranged partly in a housing containing lube oil;

a drain line connected to the housing and suitable for draining at least fuel vapour from an interior of the housing, a lube oil supply line connected to the housing;

a lube oil supply valve installed in the lube oil supply line;

a seal installed between the pumping mechanism and the housing for preventing at least lube oil leakage to the outside of the housing;

a drain valve installed in the drain line;

wherein both the drain valve and lube oil supply valve are controlled to be closed during an engine non-running state for preventing fuel vapour leakage from the housing.

2. Fuel system according to claim 1, wherein a lube oil fill level within the housing at least during the engine non-running state is set such that the seal is completely immersed in lube oil during the engine non-running state for further enhancing fuel vapour sealing of the housing.

3. Fuel system according to claim 1, wherein the lube oil supply valve is a spring loaded check valve, which is arranged to allow flow of lube oil in a single direction only.

4. A fuel system according to claim 1, wherein the lube oil supply valve is adapted to be actuated hydraulically by the engine lube oil pressure, such that the lube oil supply valve is opened in an engine running state when the oil pressure is higher, and closed in the engine non-running state when the oil pressure is low.

5. Fuel system according to claim 1, wherein the drain valve is configured to be open during an engine running state for draining at least fuel vapour from the housing.

6. Fuel system according to claim 1, wherein the drain valve is a hydraulically- or solenoid operated control valve.

7. Fuel system according to claim 1, wherein the drain valve is a spring loaded hydraulically operated control valve, wherein a pilot line of the control valve is connected to the lube oil supply line, such that a high oil pressure within the lube oil supply line caused by a running engine is arranged to open the drain valve, and a low oil pressure within the lube oil supply line caused by a non-running engine in combination with the spring loading, is arranged to close the drain valve.

8. Fuel system according to claim 1, wherein the drain line is connected to an air intake port of the engine, such that fuel vapour drained from the housing may be aspired into a combustion chamber of the engine.

9. Fuel system according to claim 1, wherein the seal is made of a conventional oil seal rubber material, such as nitrile rubber, hydrogenated nitrile rubber, silicone rubber, fluorinated rubber, or acrylic rubber, and the seal is free from any DME resistant coating.

10. Fuel system according to claim 1, wherein a section of the drain line also functions as lube oil return line, and a lube oil separator is provided along the drain line for separating lube oil from fuel vapour, wherein the lube oil separator is arranged downstream of the drain valve.

11. A fuel system according to claim 10, wherein the lube oil separator is connected to a low-pressure lube oil reservoir of the lube oil system of the engine for return of separated lube oil.

12. Fuel system according to claim 1, wherein the fuel system further comprising a lube oil return valve capable of opening and closing a lube oil return line connected to the housing.

13. Fuel system according to claim 12, wherein the lube oil return valve is configured to be open during an engine running state.

14. A fuel system according to claim 12, wherein the lube oil return valve is adapted to be closed in the engine non-running state.

15. Fuel system according to claim 1, wherein the lube oil return valve is a hydraulically- or solenoid operated control valve.

16. Fuel system according to claim 1, wherein the lube oil return valve is a spring loaded hydraulically operated control valve, wherein a pilot line of the lube oil return valve is connected to the lube oil supply line, such that a high oil pressure within the lube oil supply line caused by a running engine is arranged to open the lube oil return valve, and a low oil pressure within the lube oil supply line caused by a no running engine in combination with the spring loading is arranged to close the lube oil return valve.

17. Fuel system according to claim 1, wherein the lube oil fill level is controlled by the connection position of the lube oil return line to the housing, or by the connection position of the drain line to the housing.

18. Fuel system according to claim 1, wherein the lube oil return line is connected to a lower section of the housing, and the lube oil fill level is controlled by a lube oil level controller, which controls flow through the lube oil return valve.

19. A fuel system according to claim 1, wherein a safety means is provided that can close the drain line.

20. A fuel system according to claim 19, wherein the safety means also can close the lube oil supply line.

21. A fuel system according to claim 1, wherein a safety relief valve is connected to the housing.

22. Fuel system according to claim 1, wherein the seal is a conventional oil seal, in particular a rotary or reciprocating shaft lip seal.

23. Fuel system according to claim 1, wherein the fuel pump comprising at least one pumping chamber, and the pumping mechanism comprises at least one pumping element for expanding and contracting the pumping chamber and a driving member for driving the at least one pumping element.

24. Fuel system according to claim 23, wherein the at least one pumping element comprises a plunger, and the driving member comprises a driveshaft with at least one cam for engagement with the at least one plunger.

25. Fuel system according to claim 24, wherein a single high-pressure plunger seal is provided between the at least one plunger and a cylinder in which the plunger is reciprocally arranged.

26. Fuel system according to claim 23, wherein the driving member is rotatably arranged in the housing, and the seal is provided between the driving member and the housing.

27. Fuel system according to claim 23, wherein the driving member is rotatably arranged outside the housing, and the seal provided between the pumping element and the housing.

28. Method for reducing fuel leakage from a fuel system that is arranged to supply pressurised fuel to an internal combustion engine, the fuel system comprising a fuel pump, which has a pumping mechanism arranged partly in a housing containing lube oil, and a drain line connected to the housing and suitable for draining at least fuel vapour from an interior of the housing, characterised by the steps of connecting a lube oil supply line to the housing;

installing a lube oil supply valve in the lube oil supply line;

installing a seal between the pumping mechanism and the housing for preventing at least lube oil leakage to the outside of the housing;

installing a drain valve in the drain line; and controlling both the drain valve and lube oil supply valve to be closed during an engine non-running state for preventing fuel vapour leakage from the housing.

* * * * *